US009434903B2

(12) United States Patent
Eisenberg et al.

(10) Patent No.: US 9,434,903 B2
(45) Date of Patent: Sep. 6, 2016

(54) FRICTION-IMPROVED POLYMERS FOR DLC-COATED SURFACES

(75) Inventors: Boris Eisenberg, Heppenheim (DE); Torsten Stoehr, Frankfurt (DE)

(73) Assignee: Evonik Oil Additives GmbH, Darmstadt (DE)

( * ) Notice: Subject to any disclaimer, the term of this patent is extended or adjusted under 35 U.S.C. 154(b) by 0 days.

(21) Appl. No.: 14/005,277

(22) PCT Filed: May 10, 2012

(86) PCT No.: PCT/EP2012/058590

§ 371 (c)(1), (2), (4) Date: Sep. 16, 2013

(87) PCT Pub. No.: WO2012/156256

PCT Pub. Date: Nov. 22, 2012

(65) Prior Publication Data

US 2014/0005084 A1 Jan. 2, 2014

(30) Foreign Application Priority Data

May 17, 2011 (DE) ..... 10 2011 075 969

(51) Int. Cl.

*C04B 35/52* (2006.01)
*C10M 107/00* (2006.01)
*C10M 149/00* (2006.01)

(52) U.S. Cl.

CPC ..... *C10M 7/00* (2013.01); *C10M 149/00* (2013.01); *C10M 2203/1025* (2013.01); *C10M 2205/022* (2013.01); *C10M 2209/084* (2013.01); *C10M 2209/086* (2013.01); *C10M 2215/065* (2013.01); *C10M 2217/06* (2013.01); *C10N 2230/06* (2013.01); *C10N 2240/10* (2013.01); *C10N 2250/141* (2013.01)

(58) Field of Classification Search

CPC ..... C10M 2201/041; C10M 2209/084
USPC ..... 508/109, 470
See application file for complete search history.

(56) References Cited

U.S. PATENT DOCUMENTS 5,942,471 A * 8/1999 Kapuscinski et al. ..... 508/251
2004/0092405 A1 5/2004 Konishi et al.

FOREIGN PATENT DOCUMENTS

| | | |
|---|---|---|
| EP | 1 666 573 | 6/2006 |
| JP | 2006-306938 | 11/2006 |
| JP | 2009 091516 | 4/2009 |

(Continued)

OTHER PUBLICATIONS

International Search Report Issued Sep. 19, 2012 in PCT/EP12/058590 Filed May 10, 2012.

(Continued)

*Primary Examiner* — Vishal Vasisth
(74) *Attorney, Agent, or Firm* — Oblon, McClelland, Maier & Neustadt, L.L.P.

(57) ABSTRACT

The present invention relates to a component part comprising at least two components movable with respect to one another, between the surfaces of which is provided a film formed by a lubricant oil composition, the surface of at least one of the movable components being formed at least partly by a diamond-like-carbon layer (DLC layer) and the lubricant oil composition comprising at least one polymer comprising repeat units derived from amine derivatives of at least one polar ethylenically unsaturated monomer.

17 Claims, 1 Drawing Sheet

Graphical evaluation of the friction measurements

(56) References Cited

FOREIGN PATENT DOCUMENTS

| | | |
|---|---|---|
| JP | 2011 057766 | 3/2011 |
| WO | 2011 034026 | 3/2011 |

OTHER PUBLICATIONS

Office Action Drafted dated Nov. 13, 2015, Japanese Patent Application No. 2014-510737.

* cited by examiner

Graphical evaluation of the friction measurements
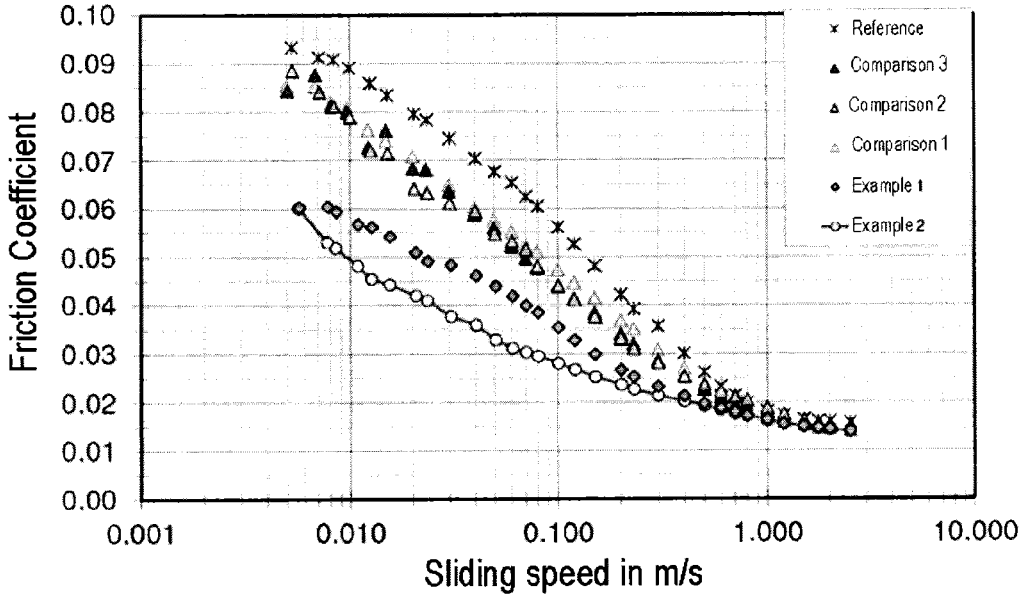

FRICTION-IMPROVED POLYMERS FOR DLC-COATED SURFACES

CROSS REFERENCE TO RELATED APPLICATIONS

The present application is a 35 U.S.C. §371 national stage patent application of International patent application PCT/EP2012/058590, filed on May 10, 2012, published as WO/2012/156256 on Nov. 22, 2012, the text of which is incorporated by reference, and claims the benefit of the filing date of German application no. 10 2011 075 969.7, filed on May 17, 2011, the text of which is also incorporated by reference.

The present invention relates to an element comprising at least two components movable with respect to one another, between the surfaces of which is provided a film formed by a lubricant oil composition.

The efficiency of modern gearboxes, engines or hydraulic pumps depends not only on the characteristics of the machine parts but also greatly on the frictional properties of the lubricant used. For the development of such lubricants, it is of particular importance to have knowledge about the action of the lubricant components used in relation to film formation and friction, and the choice of suitable additives may have the effect, for example, of lowering the average fuel consumption of a vehicle by a few percent. In this context, particularly effective constituents of a lubricant may be base oils with particularly low viscosity and hence low inherent friction, and also organic friction modifiers. One example of this trend is the newest generation of what are called fuel-economy engine oils of SAE classes 5W-20, SAE 5W-30 or SAE 0W-20, which can also be found in analogously for oils for manual and automatic gearboxes.

As a result of a development parallel to that of the fuel-saving lubricants, the use of friction-modifying additives has become even more important: the dimensions of modern gearbox and pump housings are much smaller, they are cooled less efficiently, and both gearwheels and bearings have to bear higher loads.

Recently described as additives for improving the coefficient of friction have been copolymers based on (meth) acrylates having a block structure. For instance, more particularly, publications WO 2004/087850 A1, WO 2006/105926 A1 and WO 2009/019065 A2 describe polymers having at least one polar and at least one nonpolar segment, which lead to an enhancement of the lubricant oil properties. A disadvantage of these polymers, however, is the relatively high level of complexity necessary for preparation of these additives.

In addition, there are known polymers which lead to dispersion of soot particles in the lubricant oil, and these may comprise, among other monomer units, those derived from amine derivatives of maleic acid. Such polymers are described, inter alia, in WO 2007/070845 A2, US 2004/0254080 A1 and U.S. Pat. No. 5,942,471, but there is no emphasis on any possible improvement in the friction properties of these polymers.

U.S. Pat. No. 5,942,471 describes OCP VI improvers which are grafted with maleic anhydride (MA) and then reacted with amines, including N-phenyl-1,4-phenylenediamine (DPA). Also described are improved wear characteristics in the case of soot-containing oils as a result of an improved soot dispersion.

Apart from the use of what are called friction modifiers to reduce the friction value of the lubricants used, the surface of elements naturally plays a likewise very important role. In this regard, surfaces coated with DLC (Diamond Like Carbon) are gaining ever greater industrial significance, as can be inferred, for example, from the scientific publications by M. Kalin (J. Mech. Eng., 2008, 54(3):189-206; Meccanica, 2008, 43:623-637) or A. Morina (J. Tribology, 2010, 132, 032101-1 to 032101-13; Surface&Coatings Tech., 2010, 204, 4001-4011).

In automobile construction, DLC-coated steel elements, for example camshafts or other elements of the valve train, for example roller rocker arms, are being looked into as an alternative to the customarily used pure steel elements.

Even though the use of DLC-coated materials to reduce wear constitutes an effective technical measure, the products which are typically used and exhibit extremely good action on steel are barely effective on DLC-coated surfaces.

The use of such DLC coatings, which are to be newly examined, in wear-intensive elements allows the use of lubricants comprising a lower level of antiwear additives, so-called AW components.

AW components are typically organic compounds based on sulfur, phosphorus and zinc (zinc dialkyldithiophosphates).

It is known from the prior art that the use of the AW component zinc dialkyldithiophosphate (ZDDP) leads to improved wear protection by means of the formation of a zinc sulfide coating (ZnS). If, however, particular, typically standard friction modifiers based on molybdenum compounds, for example molydimer (MD) or molytrimer (MT), are used, unwanted deposits can arise in elements of the engine, for example turbochargers.

A further disadvantage of standard friction modifiers based on molybdenum compounds is the relatively short duration over which these compounds are effective. Typically, the additives form a coating on the surfaces of the engine elements which come into contact with the lubricant. However, this coating is degraded over time, and a considerable portion of the friction-reducing effect is lost after a kilometrage of 10 000 km, such that an oil change is needed to maintain the friction-reducing action.

Interactions between the various additives used with one another and with the lubricant oil itself thus lead to disadvantages for the function and durability of the customary exhaust-gas aftertreatment systems (catalytic converters, soot particle filters). It would consequently be desirable to reduce the content thereof in modern lubricant oils as far as possible.

The elements and lubricant oil compositions described above already lead to a useable profile of properties. However, there is a constant need to improve this profile of properties.

In view of the prior art, it is thus an object of the present invention to provide an element which surpasses the prior art.

More particularly, the inventive element should enable provision of the advantages of a DLC surface which is friction-reducing compared to conventional steel surfaces in combination with the friction-reducing properties of a lubricant composition.

In addition, it was an aim of the present invention to provide a friction-reducing additive for DLC-coated steel surfaces which brings about a multitude of desirable properties in the lubricant oil composition. This can minimize the number of different additives.

Even though DLC-coated metal parts have a lower friction value compared to uncoated parts, further measures are desirable for reducing friction losses and the associated decrease in fuel consumption.

It was a further object of the invention to provide elements, lubricant oil compositions and friction-reducing additives which can be produced in a simple and inexpensive manner, and it was a particular intention to use commercially available elements. At the same time, production was to be possible on the industrial scale without any requirement for new plants or plants of complex construction for this purpose.

Furthermore, the additive was to lead to an improvement in fuel consumption, without any resulting impairment in the environmental compatibility of the lubricant oil composition.

The additives used are to improve the service life of the lubricant oil used to such an extent that the necessary oil change intervals can be extended without resulting in any decrease in quality of the lubricant oil.

These objects, and further objects which are not stated explicitly but are immediately derivable or discernible from the connections discussed herein by way of introduction, are achieved by an element having all features of claim 1. Appropriate modifications of the inventive element are protected in the dependent claims 2 to 15.

The present invention accordingly provides an element comprising at least two components movable with respect to one another, between the surfaces of which is provided a film formed by a lubricant oil composition, characterized in that the surface of at least one of the movable components is at least partly formed by a diamond-like-carbon layer (DLC layer) and the lubricant oil composition comprises at least one polymer comprising repeat units derived from amine derivatives of at least one polar ethylenically unsaturated monomer.

The inventive element can additionally achieve the following advantages among others:

Through the present invention, it is possible in an unforeseeable manner to provide an element and a lubricant oil composition with an improved profile of properties, it being possible especially through the combination of the favorable properties of a DLC coating of the elements with the lubricant oil compositions to be used in accordance with the invention to improve the service life of the engines, the fuel consumption and further desirable properties. More particularly, it is possible to achieve a very low friction value and a surprisingly high abrasion resistance.

The material characteristics of diamond and graphite result in numerous favorable properties of the DLC layers, of which resistance to abrasive wear is the most important.

Dispersing polymers comprising repeat units derived from amine derivatives of at least one polar ethylenically unsaturated monomer are known per se. However, the friction-reducing effect thereof on DLC surfaces has not been described to date.

In addition, the present invention provides elements and lubricant oil compositions which can be produced in a simple and inexpensive manner, more particularly using commercially available components. At the same time, production is possible on the industrial scale without any requirement for new plants or plants of complex construction for this purpose.

In addition, the inventive friction-reducing polymers can bring about a multitude of desirable properties in the lubricant oil composition. This can minimize the number of different additives. For example, preferred polymers lead to an improvement in the rheological properties, more particularly in the viscosity index.

Furthermore, the element and the lubricant oil composition can lead to an improvement in fuel consumption, without any associated adverse effects on environmental compatibility.

The additives used achieve an improved service life of the lubricant oil used, and so the necessary oil change intervals can be prolonged without resulting in any intolerable disadvantages.

The inventive element here may be an engine and/or a mechanical element of an engine.

Moreover, the inventive element may be characterized in that at least one of the components movable with respect to one another is a camshaft, a valve, a gearbox or a pump in an engine.

The surface of at least one of the movable components of the inventive element is at least partly formed by a diamond-like carbon layer (DLC layer).

DLC layers may be amorphous or tetragonal carbon layers having essentially properties of graphite and of diamond. They comprise $sp^2$ and $sp^3$ bonds, $sp^2$ bonds being characteristic of the graphite structure and $sp^3$ bonds characteristic of the diamond structure.

Since DLC layers consequently have both bond types as a result, reference is also made to densely amorphous diamond-like carbon layers or to densely tetragonal diamond-like carbon layers, without any intention that this should impose a restriction.

These DLC layers feature high electrical resistance, extreme hardness and visual transparency. The synthesis can be effected by means of physical gas phase deposition (physical vapor deposition, PVD) or by means of plasma-enhanced chemical gas phase deposition (plasma enhanced chemical vapor deposition, PECVD). The material is deposited as an amorphous carbon layer.

The properties of the DLC layers produced in this way, for example layer thickness, specific resistivity, hydrogen content and the like, can be adjusted within wide limits to the profile of requirements by means of variation of the various process parameters, for example the treatment time.

The methods which follow can be employed, for example, for the study of the various properties of the DLC layers produced, without any intention that this should restrict the selection of the methods. The layer thickness can be determined by means of a surface profiler, the hardness by means of a nanoindenter, the roughness or the surface structure by means of atomic force microscopy (AFM), the determination of the hydrogen concentration in the DLC layers by means of nuclear reaction analysis, and the density by means of X-ray reflectometry (XRR).

As an additional component, hydrogen can also be introduced during the coating operation, and this enters into compounds with the carbon. DLC layers may preferably comprise hydrogen in the range from 5 to 75 and preferably 10 to 65 atom percent (at %) in relation to the overall layer.

In addition, the DLC layers may be doped or undoped, the DLC layers in the case of doping comprising atoms of at least one metal and/or nonmetal. Nonexclusive examples of metallic atom dopants include titanium, tungsten and molybdenum, and nonexclusive examples of nonmetallic atom dopants include silicon, nitrogen and fluorine.

In one preferred embodiment, the inventive element may have such a configuration that the DLC layer comprises carbon present in a graphite structure ($sp^2$ hybridization), the proportion of the carbon present in a graphite structure, based on the overall carbon, being preferably in the range from 20 to 80 mol %, more preferably in the range from 30 to 70 mol %, measured by X-ray structure analysis (e.g. DIN 50433 Parts 1-4).

In addition, in a further embodiment of the invention, the inventive element may be configured such that the DLC layer comprises carbon present in a diamond structure ($sp^3$ hybridization), the proportion of the carbon present in a diamond structure, based on the overall carbon, being preferably in the range from 20 to 80 mol %, more preferably in the range from 30 to 70 mol %, measured by X-ray structure analysis (e.g. DIN 50433 Parts 1-4).

The thickness of the DLC layer used may also be in the range from 1 to 20 μm, preferably in the range from 1.5 to 15 μm and more preferably in the range from 2 to 10 μm.

The density of the DLC layer may preferably be in the range from 0.90 g/cm$^3$ to 2.20 g/cm$^3$, more preferably in the range from 0.92 to 2.15 g/cm$^3$, measured according to J. Robertson et al, *Diamond-like amorphous carbon, Materials Science and Engineering*, R37 (2002) 129. In a preferred configuration, the hardness of the DLC layer is preferably in the range from 10 GPa to 30 GPa, measured to DIN EN ISO 14577.

Further information about preferred diamond-like carbon layers (DLC layers) can be found, more particularly, in a Diplom thesis entitled "Untersuchungen zur Hochrateabscheidung harter DLC-Schichten" [Studies of high-rate deposition of hard DLC layers] by Graupner from 2004 and in A. Grill et al. Diamond-like carbon: state of the art, Diamond and Related Materials (1998), and both documents are hereby incorporated into the present application for disclosure purposes by reference.

In addition, the movable components having a surface formed at least partly by a DLC layer may at least partly be formed essentially from a metal, preferably steel. In a particular aspect, the movable component having a surface formed at least partly by a diamond-like carbon layer consists at least to an extent of 80% by weight, preferably 90% by weight, of a metal or a metal alloy, preferably a steel.

In a preferred embodiment of the invention, the inventive polymer comprising repeat units derived from amine derivatives of a polar ethylenically unsaturated monomer is a polyolefin or a polyalkyl(meth)acrylate.

It may preferably be a further feature of the inventive element in this context that the polymer comprises 0.1 to 10% by weight of repeat units derived from amine derivatives of a polar ethylenically unsaturated monomer.

The inventive polymer here may be based on polyolefins. Such polyolefins have long been known and are described in the documents cited in the prior art. These polyolefins include especially polyolefin copolymers (OCPs) and hydrogenated styrene-diene copolymers (HSDs).

The polyolefin copolymers (OCPs) for use in accordance with the invention are known per se. These are primarily polymers formed from ethylene, propylene, isoprene, butylene and/or further -olefins having 5 to 20 carbon atoms. It is likewise possible to use systems grafted with small amounts of oxygen- or nitrogen-containing monomers (for example 0.05 to 5% by weight of maleic anhydride). The copolymers containing diene components are generally hydrogenated in order to reduce the oxidation sensitivity and the crosslinking tendency.

The molecular weight $M_w$ is generally 10 000 to 300 000 Da, preferably between 50 000 and 150 000 Da. Such olefin copolymers are described, for example, in German publications DE-A 16 44 941, DE-A 17 69 834, DE-A 19 39 037, DE-A 19 63 039 and DE-A 20 59 981.

Ethylene-propylene copolymers are of particularly good usability, and terpolymers with the known ter components are likewise possible, such as ethylidene-norbornene (cf. Macromolecular Reviews, Vol. 10 (1975)), but the tendency thereof to crosslink in the course of aging should be taken into consideration. The distribution may be substantially random, but it is advantageously also possible to employ sequence polymers with ethylene blocks. The ratio of the ethylene-propylene monomers is variable within certain limits, which can be set at about 75% for ethylene and about 80% for propylene as the upper limit. As a result of the reduced solubility tendency thereof in oil, polypropylene is already less suitable than ethylene-propylene copolymers. As well as polymers having predominantly atactic propylene incorporation, those with greater iso- or syndiotactic propylene incorporation are also usable. Such products are commercially available, for example, under the trade names Dutral® CO 034, Dutral® CO 038, Dutral® CO 043, Dutral® CO 058, Buna® EPG 2050 or Buna® EPG 5050.

The hydrogenated styrene-diene copolymers (HSDs) are likewise known, these polymers being described, for example, in DE 21 56 122. These are generally hydrogenated isoprene- or butadiene-styrene copolymers. The ratio of diene to styrene is preferably in the range from 2:1 to 1:2, more preferably about 55:45. The molecular weight $M_w$ is generally 10 000 to 300 000 g/mol, preferably between 50 000 and 150 000 g/mol. The proportion of double bonds after the hydrogenation, in a particular aspect of the present invention, is not more than 15% and more preferably not more than 5%, based on the number of double bonds prior to the hydrogenation.

Hydrogenated styrene-diene copolymers can be obtained commercially under the trade name ®SHELLVIS 50, 150, 200, 250 or 260.

Polyolefins are more commercially favorable than polyalkyl(meth)acrylates, but polyalkyl(meth)acrylates lead to better rheological properties, more particularly to a higher viscosity index of the lubricant oil composition.

The inventive polymer here may also be based on (meth) acrylates. Polyalkyl(meth)acrylates are polymers by which polymerization of alkyl(meth)acrylates can be obtained. The expression "(meth)acrylates" encompasses methacrylates and acrylates and mixtures of the two. These monomers are widely known.

Polyalkyl(meth)acrylates comprise preferably at least 40% by weight, more preferably at least 60% by weight, especially preferably at least 80% by weight and most preferably at least 90% by weight of repeat units derived from (meth)acrylates, preferably alkyl (meth)acrylates.

Preferred polyalkyl(meth)acrylates comprise a) 0 to 40% by weight, especially 1 to 25% by weight and more preferably 2 to 15% by weight of repeat units derived from (meth)acrylates of the formula (I)

(I)

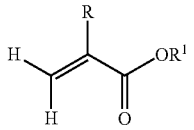

in which R is hydrogen or methyl and $R^1$ is an alkyl radical having 1 to 5 carbon atoms, b) 20 to 99.9% by weight, preferably 50 to 99.9% by weight, especially at least 70% by weight and more preferably at least 80% by weight of repeat units derived from (meth) acrylates of the formula (II)

(II)

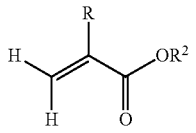

in which R is hydrogen or methyl and $R^2$ is an alkyl radical having 6 to 22 carbon atoms, c) 0 to 20% by weight, preferably 0.1 to 15% by weight, preferably 0.5 to 20% by weight and more preferably 1 to 10% by weight of repeat units derived from (meth) acrylates of the formula (III)

(III)

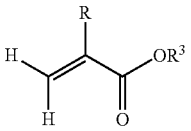

in which R is hydrogen or methyl and $R^3$ is an alkyl radical having 23 to 4000 and preferably 23 to 400 carbon atoms, and d) 0.1 to 10% by weight, preferably 1 to 8% by weight and more preferably 2 to 5% by weight of repeat units derived from amine derivatives of a polar ethylenically unsaturated monomer.

The polyalkyl(meth)acrylates can preferably be obtained by free-radical polymerization. Accordingly, the proportion by weight of the respective repeat units that these polymers contain results from the proportions by weight of corresponding monomers used to prepare the polymers.

Examples of (meth)acrylates of the formula (I) include linear and branched (meth)acrylates which derive from saturated alcohols, such as methyl (meth)acrylate, ethyl (meth)acrylate, n-propyl (meth)acrylate, isopropyl (meth) acrylate, n-butyl (meth)acrylate, tert-butyl (meth)acrylate and pentyl (meth)acrylate; and cycloalkyl (meth)acrylates such as cyclopentyl (meth)acrylate.

The (meth)acrylates of the formula (II) include especially linear and branched (meth)acrylates which derive from saturated alcohols, such as hexyl (meth)acrylate, 2-ethylhexyl (meth)acrylate, heptyl (meth)acrylate, 2-tert-butylheptyl (meth)acrylate, octyl (meth)acrylate, 3-isopropylheptyl (meth)acrylate, nonyl (meth)acrylate, decyl (meth) acrylate, undecyl (meth)acrylate, 5-methylundecyl (meth) acrylate, dodecyl (meth)acrylate, 2-methyldodecyl (meth) acrylate, tridecyl (meth)acrylate, 5-methyltridecyl (meth) acrylate, tetradecyl (meth)acrylate, pentadecyl (meth) acrylate, hexadecyl (meth)acrylate, 2-methylhexadecyl (meth)acrylate, 2-methylpentadecyl (meth)acrylate, 2-ethyltetradecyl (meth)acrylate, 2-propyltridecyl (meth)acrylate, 2-butyldodecyl (meth)acrylate, 2-methylhexadecyl (meth) acrylate, 2-pentyldodecyl (meth)acrylate, 2-hexyldecyl (meth)acrylate, 2-hexylundecyl (meth)acrylate, n-heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth)acrylate, eicosyl (meth)acrylate, docosyl (meth)acrylate;

(meth)acrylates which derive from unsaturated alcohols, for example oleyl (meth)acrylate; cycloalkyl (meth)acrylates such as cyclohexyl (meth)acrylate, 3-vinylcyclohexyl (meth)acrylate, bornyl (meth)acrylate, 2,4,5-tri-tert-butyl-3-vinylcyclohexyl (meth)acrylate, 2,3,4,5-tetra-tert-butylcyclohexyl (meth)acrylate.

Examples of monomers of the formula (III) include linear and branched (meth)acrylates which derive from saturated alcohols, such as cetyleicosyl (meth)acrylate, stearyleicosyl (meth)acrylate and/or eicosyltetratriacontyl (meth)acrylate; cycloalkyl (meth)acrylates such as 2,3,4,5-tetra-tert-hexylcyclohexyl (meth)acrylate.

In a particular configuration of the present invention, the monomers of the formula (III) include what are called polyolefin-based macromonomers with (meth)acrylate groups, which are described inter alia in DE 10 2007 032 120 A1, filed Jul. 9, 2007 at the German Patent Office with application number DE 102007032120.3; and DE 10 2007 046 223 A1, filed Sep. 26, 2007 at the German Patent Office with application number DE 102007046223.0; the disclosures of these publications, more particularly the (meth) acrylates having at least 23 carbon atoms in the radical described therein, are incorporated into the present application by reference for the purposes of disclosure.

Alkyl (meth)acrylates with a long-chain alcohol radical, especially components (II) and (III), can be obtained, for example, by reaction of (meth)acrylates and/or the corresponding acids with long-chain fatty alcohols, which generally gives rise to a mixture of esters, for example (meth) acrylates with various long-chain alcohol radicals. These fatty alcohols include Oxo Alcohol® 7911, Oxo Alcohol® 7900, Oxo Alcohol® 1100; Alfol® 610, Alfol® 810, Lial® 125 and Nafol® products (Sasol); C13-C15-Alkohol (BASF); Epal® 610 and Epal® 810 (Afton); Linevol® 79, Linevol® 911 and Neodol® 25 (Shell); Dehydad®, Hydrenol® and Lorol® products (Cognis); Acropol® 35 and Exxal® 10 (Exxon Chemicals); Kalcol® 2465 (Kao Chemicals).

A polymer for use in accordance with the invention, for example a polyalkyl(meth)acrylate or polyolefin, includes repeat units derived from amine derivatives of a polar ethylenically unsaturated monomer. The expression "polar ethylenically unsaturated monomer" makes it clear that the monomer can be free-radically polymerized. In addition, the term "polar" expresses the fact that the monomer is particularly polar even after the reaction with an amine, for example to give a higher-order amine (from primary to secondary or from secondary to tertiary), an amide or an imide in the environment of the reaction site. The groups included here include especially imide groups or carboxylic acid groups formed, which are formed, for example, in the reaction of acid anhydrides with amines, or hydroxyl groups, which are obtained in the reaction of epoxides. Carboxylic acid groups may be present here in the form of the free acid or as the salt.

Accordingly, further polar groups, for example carbonyl groups, acid groups or hydroxyl groups, are present in the environment of the amide group of the amine derivative (in the case of reaction with an anhydride) or of the amine group of the amine derivative (in the case of reaction with an epoxide). Preferably, the amide group of the amine derivative is accordingly an imide group. The term "environment of the reaction site" indicates that the polar groups which form are at most 6 and preferably at most 5 covalent bonds removed from the amine or amide group obtained, based on the distance between oxygen atom and nitrogen atom.

In one embodiment of the present invention, the polar ethylenically unsaturated monomer from which the amine derivative is derived may be maleic acid or a maleic acid derivative, for example maleic monoester, maleic diester, maleic anhydride, methyl maleic anhydride, particular preference being given to maleic anhydride.

In a further aspect of the present invention, the polar ethylenically unsaturated monomer from which the amine derivative is derived may be a (meth)acrylate having an epoxide group, particular preference being given to glycidyl (meth)acrylate.

The radical of the amine derivative of a polar ethylenically unsaturated monomer, said radical being formed from the amine, may preferably be derived from a primary amine which typically corresponds to the general formula $R^4$—$NH_2$ in which $R^4$ is a radical having 2 to 40 carbon atoms, preferably 3 to 30 and more preferably 4 to 20 carbon atoms, which may include heteroatoms.

The expression "group having 2 to 40 carbon atoms" indicates radicals of organic compounds having 2 to 40 carbon atoms. It includes not only aromatic and heteroaromatic groups but also aliphatic and heteroaliphatic groups, for example alkyl, cycloalkyl, alkoxy, cycloalkoxy, cycloalkylthio and alkenyl groups. The groups mentioned may be branched or unbranched.

According to the invention, aromatic groups refer to radicals of mono- or polycyclic aromatic compounds having preferably 6 to 20 and especially 6 to 12 carbon atoms, for example phenyl, naphthyl or biphenylyl, preferably phenyl.

Heteroaromatic groups denote aryl radicals in which at least one CH group has been replaced by N and/or at least two adjacent CH groups have been replaced by S, NH or O. These radicals include groups derived from thiophene, furan, pyrrole, thiazole, oxazole, imidazole, isothiazole, isoxazole, pyrazole, 1,3,4-oxadiazole, 1,3,4-thiadiazole, 1,3,4-triazole, 1,2,4-oxadiazole, 1,2,4-thiadiazole, 1,2,4-triazole, 1,2,3-triazole, 1,2,3,4-tetrazole, benzo[b]thiophene, benzo[b]furan, indole, benzo[c]thiophene, benzo[c]furan, isoindole, benzoxazole, benzothiazole, benzimidazole, benzisoxazole, benzisothiazole, benzopyrazole, benzothiadiazole, benzotriazole, dibenzofuran, dibenzothiophene, carbazole, pyridine, pyrazine, pyrimidine, pyridazine, 1,3,5-triazine, 1,2,4-triazine, 1,2,4,5-triazine, quinoline, isoquinoline, quinoxaline, quinazoline, cinnoline, 1,8-naphthyridine, 1,5-naphthyridine, 1,6-naphthyridine, I,'I-naphthyridine, phthalazine, pyridopyrimidine, purine, pteridine or 4H-quinolizine.

The preferred alkyl groups include the methyl, ethyl, propyl, isopropyl, 1-butyl, 2-butyl, 2-methylpropyl, tert-butyl, pentyl, 2-methylbutyl, 1,1-dimethylpropyl, hexyl, heptyl, octyl, 1,1,3,3-tetramethylbutyl, nonyl, 1-decyl, 2-decyl, undecyl, dodecyl, pentadecyl and the eicosyl group.

The preferred cycloalkyl groups include the cyclopropyl, cyclobutyl, cyclopentyl, cyclohexyl, cycloheptyl and cyclooctyl group, which are optionally substituted by branched or unbranched alkyl groups.

The preferred alkenyl groups include the vinyl, allyl, 2-methyl-2-propene, 2-butenyl, 2-pentenyl, 2-decenyl and 2-eicosenyl group.

The $R^4$ radical may have substituents. The preferred substituents include halogens, especially fluorine, chlorine, bromine, and alkoxy groups.

The reactant for derivatization of the polar ethylenically unsaturated monomers mentioned comprises at least two nitrogen atoms, preferably at least two amino groups. In a particular aspect, the number of nitrogen atoms in the reactant for of the polar ethylenically unsaturated monomers mentioned may be 2 to 6 and more preferably 2 to 4 nitrogen atoms, preferably amino groups. The term "amino group" should be understood here in a broad sense, such that aromatic compounds having a nitrogen atom, for example pyridine, also count as one of the amines. Preferably, the reactant for derivatization of the polar ethylenically unsaturated monomers mentioned comprises at least one primary or secondary amino group, particular preference being given to primary amino groups. Preferred amines from which the amine derivative of a polar ethylenically unsaturated monomer may be derived comprise preferably at least two amino groups, one amino group being a primary amino group and at least one amino group being a secondary amino group.

These amines preferably correspond to the formula $R^5$—NH—$R^6$—$NH_2$ in which $R^5$ is a radical having 1 to 18 and preferably 1 to 10 carbon atoms, and $R^6$ is a radical having 2 to 18 and preferably 2 to 10 carbon atoms.

In an embodiment preferred in accordance with the invention, at least one of the $R^5$ and $R^6$ radicals is an aromatic or heteroaromatic group.

The particularly preferred amines include the compounds of the following general formula (IIIa)

(IIIa)

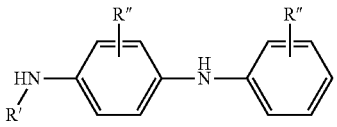

in which R' and R" may each independently be selected from the group consisting of H and an alkyl radical having 1 to 9 carbon atoms.

The particularly preferred amines, from which the derivatives of the polar ethylenically unsaturated monomers mentioned may be derived, include especially N-phenyl-1,4-phenylenediamine (DPA), N,N-dimethylaminopropylamine (DMAPA), N,N-dimethylaminoethylamine, diethylaminopropylamine, dibutylaminopropylamine, dimethylaminoethylamine, diethylaminoethylamine, dibutylaminoethylamine, 1-(2-aminoethyl)piperidine, 1-(2-aminoethyl)pyrrolidone, 4-(3-aminopropyl)morpholine, aminoethylmorpholine, for example 4-(3-aminoethyl)morpholine, N-(2-aminoethyl)-1,3-propanediamine, 3,3'-diamine-N-methyldipropylamine, tris(2-aminoethyl)amine, N,N-bis(3-aminopropyl)-1,3-propanediamine, N,N'-1,2-ethanediylbis(1,3-propanediamine), N-pyridyl-1,4-phenylenediamine, 4-aminopyridine, N-pyridyl-1,2-ethylenediamine and N-(2-ethylimidazolyl)-1,4-phenylenediamine.

The further-preferred amines, from which said derivatives of the polar ethylenically unsaturated monomers may be derived, include especially N,N-dimethylaminopropylamine (DMAPA), N,N-dimethylaminoethylamine, diethylaminopropylamine, dibutylaminopropylamine, dimethylaminoethylamine, diethylaminoethylamine, dibutylaminoethylamine, 1-(2-aminoethyl)piperidine, 1-(2-aminoethyl)pyrrolidone, 4-(3-aminopropyl)morpholine, aminoethylmorpholine, for example 4-(3-aminoethyl)morpholine, N-(2-aminoethyl)-1,3-propanediamine, 3,3'-diamine-N-methyldipropylamine, tris(2-aminoethyl)amine, N,N-bis(3-aminopropyl)-1,3-propanediamine and N,N'-1,2-ethanediylbis-(1,3-propanediamine).

The further-preferred amines from which said derivatives of the polar ethylenically unsaturated monomers may be derived include especially N-phenyl-1,4-phenylenediamine (DPA), N-pyridyl-1,4-phenylenediamine, 4-aminopyridine, N-pyridyl-1,2-ethylenediamine and N-(2-ethylimidazolyl)-1,4-phenylenediamine.

Among the amines mentioned, preference is given to N-phenyl-1,4-phenylenediamine (DPA), N,N-dimethyl-amino-propylamine (DMAPA), particular preference being given to N-phenyl-1,4-phenylenediamine.

In a particular aspect of the present invention, the repeat units derived from amine derivatives of a polar ethylenically unsaturated monomer in the polymer for use in accordance with the invention, preferably a polyalkyl(meth)acrylate and/or a polyolefin, are obtained by first preparing a polymer with reactive polar repeat units preferably derived from maleic anhydride or glycidyl (meth)acrylate. Subsequently, these reactive groups are reacted with the amines detailed above to give the polymers for use in accordance with the present invention.

In addition, the monomer mixture for preparation of the polymers for use in accordance with the invention, preferably of the polyalkyl(meth)acrylates and/or polyolefins may comprise monomers copolymerizable with the monomers detailed above. These include aryl(meth)acrylates such as benzyl methacrylate or phenyl methacrylate, where the aryl radicals may in each case be unsubstituted or up to tetrasubstituted; styrene monomers, for example styrene, substituted styrenes having an alkyl substituent in the side chain, for example α-methylstyrene and α-ethylstyrene, substituted styrenes having an alkyl substituent on the ring, such as vinyltoluene and p-methylstyrene, halogenated styrenes, for example monochlorostyrenes, dichlorostyrenes, tribromostyrenes and tetrabromostyrenes;

itaconic acid and itaconic acid derivatives, for example itaconic monoesters, itaconic diesters and itaconic anhydride;

fumaric acid and fumaric acid derivatives, for example fumaric monoesters, fumaric diesters and fumaric anhydride;

vinyl and isoprenyl ethers, for example alkyl vinyl ethers, especially methyl vinyl ether, ethyl vinyl ether and dodecyl vinyl ether;

vinyl esters, for example vinyl acetate;

1-alkenes, especially 1-butene, 1-pentene, 1-hexene, 1-heptene, 1-octene, 1-nonene, 1-decene, 1-undecene, 1-dodecene, 1-tridecene, 1-tetradecene and 1-pentadecene.

In a particular embodiment, it is especially possible to use dispersing monomers.

Dispersing monomers have long been used for functionalization of polymeric additives in lubricant oils and are therefore known to those skilled in the art (cf. R. M. Mortier, S. T. Orszulik (eds.): "Chemistry and Technology of Lubricants", Blackie Academic & Professional, London, 2nd ed. 1997). It is appropriately possible to use particularly heterocyclic vinyl compounds and/or ethylenically unsaturated, polar ester or amide compounds of the formula (IV)

(IV)

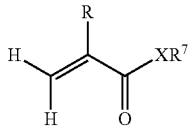

in which R is hydrogen or methyl, X is oxygen, sulfur or an amino group of the formula —NH— or —$NR^a$—, in which $R^a$ is an alkyl radical having 1 to 10 and preferably 1 to 4 carbon atoms, $R^7$ is a radical which comprises 2 to 50, especially 2 to 30 and preferably 2 to 20 carbon atoms and has at least one heteroatom, preferably at least two heteroatoms, as dispersing monomers.

Examples of dispersing monomers of the formula (IV) include aminoalkyl (meth)acrylates, aminoalkyl (meth)acrylamides, hydroxylalkyl (meth)acrylates, heterocyclic (meth) acrylates and/or carbonyl-containing (meth)acrylates.

The hydroxyalkyl (meth)acrylates include
2-hydroxypropyl (meth)acrylate,
3,4-dihydroxybutyl (meth)acrylate,
2-hydroxyethyl (meth)acrylate,
3-hydroxypropyl (meth)acrylate,
2,5-dimethyl-1,6-hexanediol (meth)acrylate and
1,10-decanediol (meth)acrylate.

Carbonyl-containing (meth)acrylates comprise, for example,
2-carboxyethyl (meth)acrylate,
carboxymethyl (meth)acrylate,
N-(methacryloyloxy)formamide,
acetonyl (meth)acrylate,
mono-2-(meth)acryloyloxyethyl succinate,
N-(meth)acryloylmorpholine,
N-(meth)acryloyl-2-pyrrolidinone,
N-(2-(meth)acryloyloxyethyl)-2-pyrrolidinone,
N-(3-(meth)acryloyloxypropyl)-2-pyrrolidinone,
N-(2-(meth)acryloyloxypentadecyl)-2-pyrrolidinone,
2-Acetoacetoxyethyl (meth)acrylate,
N-(3-(meth)acryloyloxyheptadecyl)-2-pyrrolidinone and
N-(2-(meth)acryloyloxyethyl)ethylene urea.

The heterocyclic (meth)acrylates include
2-(1-imidazolyl)ethyl (meth)acrylate,
oxazolidinylethyl (meth)acrylate,
2-(4-morpholinyl)ethyl (meth)acrylate,
1-(2-methacryloyloxyethyl)-2-pyrrolidone,
N-methacryloylmorpholine,
N-methacryloyl-2-pyrrolidinone,
N-(2-methacryloyloxyethyl)-2-pyrrolidinone,
N-(3-methacryloyloxypropyl)-2-pyrrolidinone.

The aminoalkyl (meth)acrylates include especially
N,N-dimethylaminoethyl (meth)acrylate,
N,N-dimethylaminopropyl (meth)acrylate,
N,N-diethylaminopentyl (meth)acrylate,
N,N-dibutylaminohexadecyl (meth)acrylate.

In addition, it is possible to use aminoalkyl(meth)acrylamides as dispersing monomers, such as
N,N-dimethylaminopropyl(meth)acrylamide.

In addition, it is possible to use phosphorus-, boron- and/or silicon-containing (meth)acrylates as dispersing monomers, such as
2-(dimethylphosphato)propyl (meth)acrylate,
2-(ethylenephosphito)propyl (meth)acrylate,
dimethylphosphinomethyl (meth)acrylate,
dimethylphosphonoethyl (meth)acrylate,
diethyl(meth)acryloylphosphonate,
dipropyl(meth)acryloylphosphate,
2-(dibutylphosphono)ethyl (meth)acrylate,
2,3-butylene(meth)acryloylethylborate,
methyldiethoxy(meth)acryloylethoxysilane,
diethylphosphatoethyl (meth)acrylate.

The preferred heterocyclic vinyl compounds include 2-vinylpyridine, 3-vinylpyridine, 4-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, N-vinylimidazole, 2-methyl-1-vinylimidazole, N-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles.

The particularly preferred dispersing monomers include especially ethylenically unsaturated compounds comprising at least one nitrogen atom, these being selected with particular preference from the above-detailed heterocyclic vinyl compounds and/or aminoalkyl (meth)acrylates, aminoalkyl (meth)acrylamides and/or heterocyclic (meth)acrylates.

The aforementioned ethylenically unsaturated monomers can be used individually or as mixtures. It is additionally possible to vary the monomer composition during the polymerization of the main chain in order to obtain defined structures, for example graft polymers.

Surprising advantages are exhibited especially by graft copolymers where the graft base comprises repeat units derived from olefins, and the graft layer comprises repeat units derived from amine derivatives of a polar ethylenically unsaturated monomer.

Surprising advantages are also exhibited by graft copolymers where the graft base comprises repeat units derived from (meth)acrylates having 6 to 22 carbon atoms in the alcohol radical, and the graft layer comprises repeat units derived from amine derivatives of a polar ethylenically unsaturated monomer.

Advantageously, the weight ratio of graft layer to graft base may be in the range from 1:2000 to 1:5, more preferably 1:1000 to 1:10 and more preferably 1:100 to 1:20.

In a preferred modification, the graft layer may have a very short chain, this property being determinable by comparative tests in which the graft polymerization is performed without graft base. In a particular embodiment, the number-averaged degree of polymerization of the graft layer may be at most 10, more preferably at most 5 and more preferably at most 3 repeat units.

Polyalkyl(meth)acrylates of particular interest include those which preferably have a weight-average molecular weight $M_w$ in the range from 5000 to 10 000 000 g/mol, more preferably 10 000 to 1 000 000 g/mol, even more preferably 10 000 to 750 000 g/mol and most preferably 20 000 to 500 000 g/mol.

The number-average molecular weight $M_n$ may preferably be within the range from 1000 to 500 000 g/mol, more preferably 2500 to 500 000 g/mol and most preferably 5000 to 250 000 g/mol.

Additionally appropriate are polyalkyl(meth)acrylates whose polydispersity index $M_w/M_n$ is in the range from 1.1 to 5.0, more preferably in the range from 1.4 to 4.5 and most preferably in the range from 1.6 to 3.0. The number-average and weight-average molecular weight can be determined by known processes, for example gel permeation chromatography (GPC), preferably using a PMMA standard. The molecular weight of the polymer can preferably be performed prior to the derivatization thereof with an amine.

The preparation of the polyalkyl(meth)acrylates from the above-described compositions is known per se. For instance, these polymers can be obtained especially by free-radical polymerization, and also related processes, for example ATRP (=Atom Transfer Radical Polymerization) or RAFT (=Reversible Addition Fragmentation Chain Transfer).

The ATRP process is known per se. This reaction regime is described, for example, by J.-S. Wang, et al., J. Am. Chem. Soc., vol. 117, p. 5614-5615 (1995), by Matyjaszewski, Macromolecules, vol. 28, p. 7901-7910 (1995). In addition, patent applications WO 96/30421, WO 97/47661, WO 97/18247, WO 98/40415 and WO 99/10387 disclose variants of the above-described ATRP.

In addition, the inventive polymers can be obtained, for example, via RAFT methods too. This method is explained in detail, for example, in WO 98/01478 and WO 2004/083169, to which explicit reference is made for the purposes of the disclosure.

In addition, the inventive polymers are obtainable by NMP processes (nitroxide-mediated polymerization), which are described in U.S. Pat. No. 4,581,429 inter alia.

One comprehensive description, more particularly with further references, of these methods is given in K. Matyjaszewski, T. P. Davis, Handbook of Radical Polymerization, Wiley Interscience, Hoboken 2002, to which explicit reference is made for the purposes of disclosure.

The free-radical polymerization of the ethylenically unsaturated compounds can be effected in a manner known per se. Customary free-radical polymerization is described inter alia in Ullmann's Encyclopedia of Industrial Chemistry, Sixth Edition.

In the context of the present invention, the polymerization is initiated using at least one polymerization initiator for free-radical polymerization. These include the azo initiators widely known in the specialist field, such as 2,2'-azobisisobutyronitrile, 2,2'-azobis(2,4-dimethylvaleronitrile) and 1,1-azobiscyclohexanecarbonitrile, organic peroxides such as dicumyl peroxide, diacyl peroxides such as dilauroyl peroxide, peroxy-dicarbonates such as diisopropyl peroxydicarbonate, peresters such as tert-butyl peroxy-2-ethylhexanoate, and the like.

Polymerization initiators of very particular suitability for the purposes of the present invention include especially the following compounds:

methyl ethyl ketone peroxide, acetylacetone peroxide, dilauroyl peroxide, tert-butyl per-2-ethylhexanoate, ketone peroxide, tert-butyl peroctoate, methyl isobutyl ketone peroxide, cyclohexanone peroxide, dibenzoyl peroxide, tert-butyl peroxybenzoate, tert-butyl peroxyisopropylcarbonate, 2,5-bis(2-ethylhexanoylperoxy)-2,5-dimethylhexane, tert-butyl peroxy-2-ethylhexanoate, tert-butyl peroxy-3,5,5-trimethylhexanoate, dicumyl peroxide, 1,1-bis(tert-butylperoxy)cyclohexane, 1,1-bis(tert-butylperoxy)-3,3,5-trimethylcyclohexane, cumyl hydroperoxide, tert-butyl hydroperoxide, bis(4-tert-butylcyclohexyl)peroxydicarbonate, 2,2'-azobisisobutyronitrile, 2,2'-azobis(2,4-dimethylvaleronitrile), 1,1-azobiscyclohexanecarbonitrile, diisopropylperoxydicarbonate, tert-amyl peroxypivalate, di(2,4-dichlorobenzoyl)peroxide, tert-butyl peroxypivalate, 2,2'-azobis(2-amidinopropane)dihydrochloride, di(3,5,5-trimethylhexanoyl)peroxide, dioctanoyl peroxide, didecanoyl peroxide, 2,2'-azobis(N,N'-dimethyleneisobutyramidine), di(2-methylbenzoyl)peroxide, dimethyl 2,2'-azobisisobutyrate, 2,2'-azobis(2-methylbutyronitrile), 2,5-dimethyl-2,5-di(2-ethylhexanoylperoxy)hexane, 4,4'-azobis(cyanopentanoic acid), di(4-methylbenzoyl)peroxide, dibenzoyl peroxide, tert-amyl peroxy-2-ethylhexanoate, tert-butyl peroxy-2-ethylhexanoate, tert-butyl peroxyisobutyrate and mixtures of the aforementioned polymerization initiators.

According to the invention, very particular preference is given to polymerization initiators having a half-life of 1 hour at a temperature in the range from 25° C. to 200° C., preferably in the range from 50° C. to 150° C., especially in the range from 50° C. to 120° C. In addition, peroxidic polymerization initiators, especially tert-butyl peroctoate, are very particularly suitable for the present purposes.

The process can be performed either in the presence or in the absence of a chain transferer. The chain transferers, also called molecular weight regulators, used may be typical species described for free-radical polymerizations, as known to those skilled in the art.

The sulfur-free molecular weight regulators include, for example, without any intention that this should impose a restriction, dimeric α-methylstyrene (2,4-diphenyl-4-methyl-1-pentene), enol ethers of aliphatic and/or cycloaliphatic aldehydes, terpenes, β-terpinene, terpinolene, 1,4-cyclohexadiene, 1,4-dihydronaphthalene, 1,4,5,8-tetrahydronaphthalene, 2,5-dihydrofuran, 2,5-dimethylfuran and/or 3,6-dihydro-2H-pyran, preference being given to dimeric α-methylstyrene.

The sulfur-containing molecular weight regulators used may preferably be mercapto compounds, dialkyl sulfides, dialkyl disulfides and/or diaryl sulfides. The following polymerization regulators are mentioned by way of example: di-n-butyl sulfide, di-n-octyl sulfide, diphenyl sulfide, thiodiglycol, ethylthioethanol, diisopropyl disulfide, di-n-butyl disulfide, di-n-hexyl disulfide, diacetyl disulfide, diethanol sulfide, di-tert-butyl trisulfide and dimethyl sulfoxide. Compounds used with preference as molecular weight regulators are mercapto compounds, dialkyl sulfides, dialkyl disulfides and/or diaryl sulfides. Examples of these compounds are ethyl thioglycolate, 2-ethylhexyl thioglycolate, pentaerythritol tetrathioglycolate, cysteine, 2-mercaptoethanol, 1,3-mercapto-propanol, 3-mercaptopropane-1,2-diol, 1,4-mercaptobutanol, mercaptoacetic acid, 3-mercaptopropionic acid, thioglycolic acid, mercaptosuccinic acid, thioglycerol, thioacetic acid, thiourea and alkyl mercaptans such as n-butyl mercaptan, n-hexyl mercaptan, tert-dodecyl mercaptan or n-dodecyl mercaptan. Polymerization regulators used with particular preference are mercapto alcohols and mercapto carboxylic acids. In the context of the present invention, very particular preference is given to the use of n-dodecyl mercaptan and tert-dodecyl mercaptan as chain transferers.

The repeat units derived from amine derivatives of a polar ethylenically unsaturated monomer in the polyalkyl(meth) acrylate are preferably obtained by a polymer-analogous reaction after the above-described preparation of a polyalkyl (meth)acrylate. Accordingly, it is possible with preference first to prepare a polymer with reactive polar units, the reactive units being reacted with an amine of the type described above. The reactive polar units include especially anhydride or epoxide units.

The reaction of the reactive polar units present in the polymer, preferably of the anhydride or epoxide groups, with amines can be effected typically between 40° C. and 180° C., preferably between 80° C. and 180° C. and more preferably between 100° C. and 160° C. The amine can preferably be added in an equimolar amount to the reactive polar groups, preferably to the anhydride or epoxide groups. If excess amounts of amine are added, it can subsequently be removed from the mixture. In the case of excessively small proportions, reactive groups remain, which can optionally be converted to less reactive groups by addition of small amounts of water.

The amine can be added in pure form or be added to the reaction mixture in a suitable solvent. Preference is given to polar solvents, especially esters, e.g. butyl acetate or diisononyl adipate (Plastomoll DNA).

According to the nature of the reactive reactant group converted, water may be formed. For example, in the case of use of anhydride groups, water is released, which, in a particular aspect of the present invention, can be removed substantially completely from the reaction mixture, it being possible to drive out water, for example, by means of dry nitrogen. In addition, it is possible to use desiccants. Volatile solvents such as butyl acetate, if used, can be distilled off after the reaction, preferably under reduced pressure.

The polymers for use in accordance with the invention are preferably used to improve lubricant oil properties. The lubricant oils include especially mineral oils, synthetic oils and natural oils.

In general, a distinction is drawn between paraffin-base, naphthenic and aromatic fractions in crude oils or mineral oils, in which the term paraffin-base fraction represents longer-chain or highly branched isoalkanes, and naphthenic fraction represents cycloalkanes.

Synthetic oils include organic esters, for example diesters and polyesters, polyalkylene glycols, polyethers, synthetic hydrocarbons, especially polyolefins, among which preference is given to polyalphaolefins (PAOs), silicone oils and perfluoroalkyl ethers.

Natural oils are animal or vegetable oils, for example neatsfoot oils or jojoba oils.

Base oils for lubricant oil formulations are divided into groups according to API (American Petroleum Institute). Mineral oils are divided into group I (non-hydrogen-treated) and, depending on the degree of saturation, sulfur content and viscosity index, into groups II and III (both hydrogen-treated). PAOs correspond to group IV. All other base oils are encompassed in group V.

These lubricant oils may also be used as mixtures and are in many cases commercially available.

The concentration of the inventive polyalkyl(meth)acrylate in the lubricant oil composition is preferably in the range of 0.01 to 30% by weight, more preferably in the range of 0.1 to 20% by weight and most preferably in the range of 0.5 to 15% by weight, based on the total weight of the composition.

In addition to the polymers comprising ester groups for use in accordance with the invention, the lubricant oil compositions detailed here may also comprise further additives. These additives include VI improvers, pour point improvers and DI additives (dispersants, detergents, defoamers, corrosion inhibitors, antioxidants, antiwear and extreme pressure additives, friction modifiers).

Preferred lubricant oil compositions have a viscosity, measured at 40° C. according to ASTM D 445, in the range of 10 to 120 $mm^2/s$, more preferably in the range of 15 to 100 $mm^2/s$. The kinematic viscosity $KV_{100}$ measured at 100° C. is preferably at least 2.0 $mm^2/s$, more preferably at least 3.5 $mm^2/s$ and most preferably at least 4.0 $mm^2/s$.

In addition, the inventive polymer may feature a segmented structure, in which case the polar, oil-insoluble segments comprise the repeat units derived from amine derivatives of a polar ethylenically unsaturated monomer, and the nonpolar, soluble segments consist of repeat units which ensure good oil solubility of the overall polymer.

In a particularly preferred embodiment, the inventive polymer comprises more nonpolar than polar segments.

The invention is illustrated in more detail hereinafter by examples, without any intention that this should impose a restriction.

EXAMPLES AND COMPARATIVE EXAMPLES

Polymer Synthesis:

Example 1

Inventive Polymer 224 g of LMA (alkyl methacrylate having 12 to 14 carbon atoms in the alkyl radical), 0.5 g of SMA (alkyl methacrylate having 16 to 18 carbon atoms in the alkyl radical), 0.5 g of DPMA (alkyl methacrylate having 12 to 15 carbon atoms in the alkyl radical), 25 g of MMA (methyl methacrylate) and 0.75 g of DDM (n-dodecyl mercaptan) were used to make up a reaction mixture. 97.2 g of KPE 100 N oil were initially charged in the reaction flask which was equipped with internal temperature regulation, stirrer, nitrogen inlet and condenser, and 10.8 g of the abovementioned reaction mixture were added. Subsequently, the mixture was heated to 105° C. while stirring and introducing nitrogen. On attainment of the reaction temperature, an amount of 0.99 g of tBPO (tert-butyl perbenzoate) was fed in and the monomer feed was started. The monomer feed consisted of the rest of the reaction mixture, to which 8.6 g of tBPO had been added. The feed was effected simultaneously over 3.5 hours. 2 hours after feeding had ended, another 0.5 g of tBPO was fed in at 95° C. The mixture was kept at 105° C. for a further 2 hours. This was followed by heating to 130° C., addition of 7.7 g of MA (maleic anhydride) and starting of the graft reaction with 0.64 g of tBPB. 1 and 2 hours after commencement of the grafting reaction, another 0.32 g of tBPB was fed in. After the last addition of initiator, the mixture was stirred at 130° C. for another 3 hours.

Amine Derivatization:

The conversion of the anhydride present in the polymer was effected in a polymer-analogous reaction with N-phenyl-1,4-phenylenediamine (DPA) at 140° C. 14.5 g of DPA were dissolved in 58.1 g of diisononyl adipate and the solution was added homogeneously within 1.5 h. Water formed was driven out by blowing in dry nitrogen. The inventive polymers converted to completion, after the reaction had ended, were pressure-filtered through a depth filter layer (SEITZ T1000) to remove impurities. The polymer content of the end product was 62%.

Example 2

Inventive Polymer 100 grams of ethylene-propylene copolymer (EPM) containing 0.9% by weight of succinimide anhydride groups (EPSA) were dissolved in 400 grams of mineral oil (SNO-100) under a nitrogen atmosphere by stirring at 155° C. for 3 hours.

2.4 grams of N-phenyl-p-phenylene (NPPDA), which had been dissolved in 29 grams of Surfonic L24-7 (surfactant, ethoxylated linear alcohol) were subsequently added. The reaction was stirred at 165° C. under a nitrogen atmosphere for a further 4 hours.

Subsequently, the neutral oil (SNO-100) was added as a solvent, which resulted in a polymer solution having a content of 13% by weight of polymer.

Comparative Examples 1-3

The synthesis of the block polymers which are employed as comparative examples was effected as described in WO 2004/087850 or WO 2006/105926. The composition of the polymers is as follows:

Comparative Example CompEx1 p[LMA-co-SMA-DPMA]-b-MOEMA=92.1-0.2-0.2-7.5% by weight

Comparative Example CompEx2 p[LIMA-co-Sty]-b-EUMA=88.9-3.7-7.4% by weight

Comparative Example CompEx3 p[LIMA-co-Sty]-b-AcAcOEMA=89.4-3.7-6.9% by weight

Determination of Friction-reducing Action:

All polymers tested were diluted to a KV100 of 6.50 $mm^2/s$ in an API group III oil, Nexbase 3030. The reference oil used for all measurements was Nexbase 3030, which was adjusted to KV100=6.50 $mm^2/s$ with Viscoplex 0-050. The measurement of the coefficient of friction at 120° C. was effected as described in WO 2004/087850, except that DLC-coated disks and balls were used rather than the usual steel test specimens. The DLC layer of thickness 2-3 μm corresponded to the a-C:H, $sp^2$ type—a DLC type, the production of which involved adding relatively large amounts of hydrogen to the plasma, which leads to an enhanced degree of formation of a graphite-like structure ($sp^2$ hybrid) of the carbon at the surface. Further details of this type can be found, for example, in the following references: A. Grill et al, Diamond-like carbon: state of the art, Diamond and Related Materials (1998) or report VDI2840, Association of German Engineers (2006).

The evaluation of the friction value measurements is shown in the graph in FIG. 1. A quantifiable result with which the reduction in friction can be expressed as a number is obtained as follows:

integration of the friction value curves in the range of sliding speed 0.005-2.5 m/s. The area corresponds to the "total friction" over the entire speed range examined. The smaller the area, the greater the friction-reducing effect of the polymer examined.

The areas determined and the percentage friction reductions calculated therefrom in relation to the reference oil are compiled in table 1.

TABLE 1

Quantitative evaluation of the reduction in friction

| | Reference | Example 1 | Example 2 | Comparison 1 | Comparison 2 | Comparison 3 |
|---|---|---|---|---|---|---|
| Area in mm/s | 56.837 | 45.331 | 43.316 | 51.546 | 52.165 | 50.733 |
| % reduction in friction relative to reference | 0.0% | 20.2% | 23.8% | 9.3% | 8.2% | 10.7% |

The data in FIG. 1 and table 1 show clearly that the inventive polymers have a much better effect with regard to the reduction in friction than the corresponding comparative polymers of the prior art. On average, the friction-reducing effect of the inventive polymers is twice as good as for those of the prior art.

Since the low speeds are of particular economic interest for the use of the lubricant compositions for use in accordance with the invention in combination with the elements for use in accordance with the invention, table 2 shows the integration data of the friction value curves within the sliding speed range from 0.01 to 0.1 m/s.

The areas determined and the percentage reductions in friction calculated therefrom in relation to the reference oil are compiled in table 2 in an analogous manner to table 1.

TABLE 2

| Quantitative evaluation of the reduction in friction at low frequency | | | | | | |
|---|---|---|---|---|---|---|
| | Reference | Example 1 | Example 2 | Comparison 1 | Comparison 2 | Comparison 3 |
| Area in mm/s | 6.260 | 4.030 | 3.160 | 5.366 | 5.127 | 5.176 |
| % reduction in friction relative to reference | 0.0% | 35.6% | 49.5% | 14.3% | 18.1% | 17.3% |

The data in table 2 show clearly that the inventive polymers have a much better effect once again with regard to the reduction in friction than the corresponding comparative polymers of the prior art.

Compared to the results in table 1, it is found that the friction-increasing action of lubricant composition for use in accordance with the invention in combination with the corresponding element is very clearly marked specifically within the range of low sliding speeds. The friction-reducing effect of the inventive polymers can, for example, be more than three times as good as that in the prior art (example 2 compared to comparative example 1).

The inventive component part and the inventive lubricant oil composition are defined by the characterizing features of the appended claims.

The invention claimed is:

1. An element comprising at least two components movable with respect to one another, between surfaces of which is disposed a film comprising a lubricant oil composition, wherein a surface of at least one of the movable components comprises a diamond-like-carbon layer (DLC layer) and the lubricant oil composition comprises 0.5 to 15% by weight of a polymer comprising a repeat unit derived from an amine derivative of at least one polar ethylenically unsaturated monomer, the amine derivative being derived from N-phenyl-1,4-phenylenediamine, wherein:

the polar ethylenically unsaturated monomer from which the amine derivative is derived is maleic anhydride.

2. The element of claim 1, wherein the DLC layer comprises carbon present in a graphite structure, wherein a proportion of the carbon present in a graphite structure, based on an overall amount of carbon, is in a range from 30 to 70 mol %.

3. The element of claim 1, wherein the DLC layer comprises carbon present in a diamond structure, wherein a proportion of the carbon present in a diamond structure, based on an overall amount of carbon, is in a range from 30 to 70 mol %.

4. The element of claim 1, wherein a thickness of the DLC layer is in a range from 1 to 20 μm.

5. The element of claim 1, wherein the polymer comprises 0.1 to 10% by weight of the repeat unit derived from the amine derivative of the polar ethylenically unsaturated monomer.

6. The element of claim 1, wherein the polymer is a polyolefin.

7. The element of claim 1, wherein the polymer is a polyalkyl(meth)acrylate.

8. The element of claim 1, which is an engine.

9. The element of claim 8, wherein at least one of the components movable with respect to one another is a camshaft or a valve.

10. The element of claim 1, wherein the polymer is a graft copolymer where a graft layer comprises the repeat unit derived from the amine derivative of the polar ethylenically unsaturated monomer.

11. The element of claim 10, wherein a graft base of the graft copolymer comprises a polyolefin or a polyalkyl(meth) acrylate.

12. The element of claim 11, wherein the polyolefin is an ethylene-propylene copolymer, and the polyalkyl(meth) acrylate comprises alkyl radicals having from 12 to 18 carbon atoms.

13. The element of claim 12, wherein a thickness of the DLC layer is in a range from 2 to 3 μm.

14. The element of claim 13, wherein the lubricant oil composition further comprises an API group III oil.

15. The element of claim 14, which (i) exhibits a reduction in friction, integrated over a range of sliding speeds of 0.005 to 2.5 m/s, of 20% or more compared to a reference element, and (ii) exhibits a reduction in friction, integrated over a range of sliding speeds of 0.01 to 0.1 m/s, of 35% or more compared to a reference element, wherein the reference element is identical to the element of claim 1 except that the lubricant oil composition of the reference element does not comprise the polymer.

16. The element of claim 1, which exhibits a reduction in friction, integrated over a range of sliding speeds of 0.005 to 2.5 m/s, of 20% or more compared to a reference element, wherein the reference element is identical to the element of claim 1 except that the lubricant oil composition of the reference element does not comprise the polymer.

17. The element of claim 1, which exhibits a reduction in friction, integrated over a range of sliding speeds of 0.01 to 0.1 m/s, of 35% or more compared to a reference element, wherein the reference element is identical to the element of claim 1 except that the lubricant oil composition of the reference element does not comprise the polymer.

* * * * *